United States Patent [19]

Yokoyama et al.

[11] 4,366,238

[45] Dec. 28, 1982

[54] SILVER HALIDE PHOTOGRAPHIC MATERIALS

[75] Inventors: Shigeki Yokoyama; Kunihiko Ohga, both of Minami-ashigara, Japan

[73] Assignee: Fuji Photo Film Co., Ltd., Kanagawa, Japan

[21] Appl. No.: 277,375

[22] Filed: Jun. 25, 1981

[51] Int. Cl.[3] ..... E03C 1/78; E03C 1/72

[52] U.S. Cl. ..... 430/529; 430/527; 430/536; 430/537; 430/627; 430/631; 430/961

[58] Field of Search ..... 430/527, 529, 627, 631, 430/377, 531, 536, 537, 609, 961

[56] References Cited

U.S. PATENT DOCUMENTS

| | | | |
|---|---|---|---|
| 2,816,028 | 12/1957 | Minsk | 430/627 |
| 2,852,382 | 9/1958 | Illingsworth et al. | 430/627 |
| 3,753,716 | 8/1973 | Ishihara et al. | 430/627 |
| 3,840,371 | 10/1974 | Usami et al. | 430/537 |
| 3,850,642 | 11/1974 | Bailey et al. | 430/634 |
| 4,229,524 | 10/1980 | Yoneyama et al. | 430/631 |
| 4,247,627 | 1/1981 | Chen | 430/537 |
| 4,266,015 | 5/1981 | Butler et al. | 430/527 |

FOREIGN PATENT DOCUMENTS

| | | | |
|---|---|---|---|
| 56-19047 | 2/1981 | Japan | 430/527 |
| 1111692 | 5/1968 | United Kingdom | 430/631 |

OTHER PUBLICATIONS

Research Disclosure, Jul. 1980, No. 19551, pp. 301–310.

*Primary Examiner*—Mary F. Downey

*Attorney, Agent, or Firm*—Sughrue, Mion, Zinn, Macpeak & Seas

[57] ABSTRACT

The antistatic property of a silver halide photographic material is effectively improved by incorporating a fluorine-containing water-insoluble polymer having a styrene monomer containing a fluorine-containing group as the polymerization unit in at least one of the photographic layers of the photographic material. The incorporation of the polymer does not reduce the adhesion resistance or film strength of the photographic material. The photographic material can also maintain the improved antistatic property for a long period of time.

8 Claims, No Drawings

SILVER HALIDE PHOTOGRAPHIC MATERIALS

FIELD OF THE INVENTION

This invention relates to silver halide photographic materials (which herein refers to "photographic materials") and more particularly to photographic materials having improved antistatic property.

BACKGROUND OF THE INVENTION

Since photographic material is generally composed of a support having an electric-insulating property and photographic layers formed thereon, an electrostatic charge is frequently accumulated on the photographic material by the contact friction of the surface thereof with the surface of the same kind of photographic material or a foreign material. An electrostatic charge can also be accumulated by the separation of the surface thereof from the surface of the same kind of photographic material or a foreign material during the production thereof or during use. The accumulated electrostatic charge causes various problems the most serious of which is that the accumulated electrostatic charge is discharged before development. This discharge partially exposes the photosensitive silver halide emulsion layers of the photographic material. This partial exposure rsults in forming dot-like spots or branch-like or feather-like spots after development of the photographic material. These spots or so-called static marks greatly reduce the commercial value of the photographic film. The problems resulting from the formation of static marks on medical or industrial X-ray film are apparent. The occurrence of this phenomenon creates an addition problem since the occurrence of the phenomenon cannot be confirmed prior to development of the photographic material. Furthermore, the accumulated electrostatic charge induces secondary problems such as attaching dust onto the surface of the photographic film and making it difficult to uniformly coat photographic layers on the support.

An electrostatic charge, as described above, is frequently accumulated during the production and use of photographic materials. For example, an electrostatic charge is created by frictional contact between a photographic film and rollers during the production step for the photographic film or by the separation of the support of a photographic film from the silver halide emulsion layer surface thereof during the winding or rewinding process of the photographic film. Furthermore, an electrostatic charge is created by the contact friction of an X-ray film with a mechanical part or a fluorescent intensifying screen in an automatic X-ray camera, and by the contact friction of a photographic film with a packaging material. The occurrence of the static mark of a photographic material induced by the accumulation of such an electrostatic charge becomes increasingly serious as the sensitivity and processing speed of the photographic material increase. In recent times, photographic material is frequently subjected to severe processings such as high sensitization and high speed coating of photographic material, high speed photographing, high speed automatic processing. Accordingly, the static mark is more likely to form.

In order to remove problems created by the electrostatic charge, it is preferable to add antistatic agents to photographic materials. However, antistatic agents generally used in other fields than photography cannot always be used as the antistatic agents for photographic materials. Furthermore, there are various restrictions specific to photographic materials about the antistatic agents which are used for photographic materials. In addition to possessing excellent antistatic properties, the antistatic agents used in photographic materials must not give bad influences on the photographic properties of photographic materials, such as the sensitivity, fog formation, granularity, sharpness. Furthermore, the agents must not have: bad influences on the film strength of photographic materials (i.e., the photographic materials containing the antistatic agents are not readily scratched when rubbed together or scraped with solid materials); or bad influences on the adhesive property of the photographic materials (.e., the photographic materials containing the antistatic agents do not readily stick to each other or to the surfaces of foreign materials). Furthermore, the agents must not accelerate fatigue of processing solutions for photographic materials or reduce the bonding strength between the photographic layers of the photographic materials. Thus, there are many restrictions with respect to the application of antistatic agents to photographic materials.

In accordance with one method for eliminating problems created by electrostatic charge, the electric conductivity of the surface of a photographic material is increased so that the electrostatic charge flees in a short period of time before the charge is accumulated and discharged.

There have been prior attempts to improve the electric conductivity of the supports for photographic materials and various coated surface layers and the utilization of various hygroscopic materials or water-soluble inorganic salts. These attempts involve the use of certain kinds of surface active agents, polymers. For example, there are the polymers as described in U.S. Pat. Nos. 2,882,157, 2,972,535, 3,062,785, 3,262,807, 3,514,291, 3,615,531, 3,753,716, 3,938,999, etc.; the surface active agents as described in U.S. Pat. Nos. 2,982,651, 3,428,456, 3,457,076, 3,454,625, 3,552,972, 3,655,387, etc.; and the metal oxides and colloidal silicas as described in U.S. Pat. Nos. 3,062,700, 3,245,833, 3,525,621, etc.

However, these materials show a different specificity for different kind of film support or different photographic composition. Therefore, some materials described above give good results for specific film supports and photographic silver halide emulsions or other photographic constituting elements. However, they are not only useless for static prevention of other film supports and photographic constituting elements but have bad influences on photographic properties.

Other materials possess an excellent antistatic effect but cannot be used for photographic materials because they have bad influences on photographic materials such as the sensitivity of photographic silver halide emulsions, the formation of fog, granularity and sharpness. For example, it is generally known that polyethylene oxide series compounds have an antistatic effect. However, they frequently have adverse influences on the photographic properties, such as the increase of fog, the desensitization and the deterioration in granularity. Particularly, in a photographic material having photographic silver halide emulsion layers coated on both sides of a support as a medical direct X-ray photographic film, it has been difficult to establish a technique of effectively creating an antistatic property without having bad influences on the photographic properties.

As described above, the application of antistatic agents to photographic materials frequently encounters various difficulties and the applicable range is limited.

According to another method of eliminating the problems on photographic materials caused by electrostatic charge, the static potential of the surface of a photograhic material is controlled. This minimizes the generation of static electricity by friction or contact as described before.

For example, attempts have been made which utilize fluorine-containing surface active agents as described in British Pat. Nos. 1,330,356 and 1,524,631, U.S. Pat. Nos. 3,666,478 and 3,589,906, Japanese Patent Publication No. 26687/77 and Japanese Patent Application (OPI) Nos. 46733/74 and 32322/76 (the term "OPI" as used herein refers to a "published unexamined Japanese patent application"). However, since the electrostatic characteristics of the photographic materials containing these fluorine-containing surface active agents utilize the characteristics of surface active agent, such as a monomolecular film formation, etc., they are greatly dependent upon the conditions for producing these photographic materials. Therefore, it is very difficult to produce stable photographic products having constant quality and constant electrostatic characteristics. For example, the electrostatic characteristics of photographic materials produced change greatly dependent upon temperature and humidity during the coating of photographic layers on supports, as well as temperature, humidity and drying time during drying of the photographic materials after coating. Photographic products having good properties are obtained under certain conditions but photographic materials having very inferior electrostatic characteristics are formed in other cases. This creates a serious problem with respect to quality control. The fluorine-containing surface active agents are inferior in that even if the photographic materials containing these surface active agents have good electrostatic characteristics immediately after production, the electrostatic characteristics become inferior with the passage of time.

In an attempt to overcome the difficulties caused by the use of these fluorine-containing surface active agents, fluorine-containing polymers have been used in photographic materials. These attempts involve the use of homopolymers or copolymers of the acrylic acid esters or methacrylic acid esters of fluorine-containing alcohols as described in British Pat. No. 1,497,256; the use of copolymers prepared by copolymerizing the aforesaid fluorine-containing monomers and a monomer having a polyethylene oxide chain as described in Japanese Patent Application (OPI) No. 158222/79; the use of copolymers prepared by copolymerizing the aforesaid fluorine-containing monomers or such fluorine-containing monomers as the vinyl esters of fluorine-containing carboxylic acids, fluorine-containing vinyl ethers, fluorine-substituted olefins, etc., with a monomer having quaternary nitrogen as described in British Pat. No. 1,535,685; or the use of interpolymers prepared by interpolymerizing the maleic acid esters of a fluorine-containing alcohol, maleic acid, and other monomer. However, since the photographic layers of photographic materials containing these polymers have high tackiness, the emulsion layers of the photographic materials are likely to stick to each other or to the back surfaces thereof when they are contacted. It therefore becomes difficult to separate them. Furthermore, visible adhesion stains remain after separating them from each other, greatly reducing the commercial value of the photographic materials. Also, the photographic layers of the photographic materials containing these polymers are likely to be scratched by rubbing with or scraping with other materials, which also greatly reduces the commercial value of the photographic materials.

SUMMARY OF THE INVENTION

A first object of this invention is, therefore, to provide photographic materials having improved antistatic properties.

A second object of this invention is to provide photographic materials having a combination of good antistatic properties and good adhesion resistance.

A third object of this invention is to provide static preventing photographic materials which have high film strength and are resistant to being scratched.

A fourth object of this invention is to provide photographic materials which can be stably produced with constant qualities without changing the electrostatic properties thereof by the production conditions therefor.

A fifth object of this invention is to provide photographic materials having stable qualities, the electrostatic properties of which do not change with the passage of time after the production thereof.

A sixth object of this invention is to provide photographic materials of which the antistatic property has been improved without having adverse influences on the photographic properties such as the sensitivity, the formation of fog or the granularity.

A seventh object of this invention is to provide photographic material which can be produced easily and efficiently.

These objects can be attained by incorporating in at least one of the layers constituting a photographic material a fluorine-containing water-insoluble polymer (i.e., a polymer having a solubility of less than 0.1 g/100 g water at 20° C.) having the styrene monomer having a fluorine-substituted group as shown by following general formula (I) as the polymerization unit:

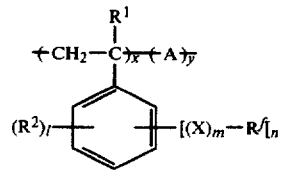

(I)

wherein A represents a monomer unit formed by the copolymerization of a copolymerizable monomer having at least one ethylenically unsaturated group; $R^1$ represents hydrogen, a halogen atom, or an alkyl group having 1 to 3 carbon atoms; $R^2$ can represent a monovalent substituent, and, when l is more than one, two $R^2$ groups together can represent an atomic group forming a ring; $R_f$ represents an alkyl group having 1 to 30 carbon atoms, an aralkyl group, an aryl group, or an alkylaryl group, wherein at least one hydrogen has been substituted by a fluorine atom; X represents a divalent coupling group shown by general formula $-(R)_p-L-$ (wherein R is an alkylene group, an arylene group, or an aralkylene group; L is an oxy group, a thioxy group, an imino group, a carbonyl group, a carboxy group, a carboxythio group, a carboxyamido group, an oxycarbonyl group, a carbamoyl group, a sulfone group, a sulfonamido group, an N-alkylsulfonamido group, a sulfamoyl group, a sulfoxyl group or a phosphate group; and p is 0 or 1); l is an integer of 0 to 4; m is an integer of 0 to 3; n is an integer of 1 to 5; x is 1 to 100 mol% and y is 0 to 99 mol%.

DETAILED DESCRIPTION OF THE INVENTION

The preferred polymers of this invention are described below in detail. In general formula (I), A represents a monomer unit formed by the copolymerization of a copolymerizable monomer having at least one ethylenically unsaturated group and examples of the monomer are olefins such as ethylene, propylene, 1-butene, etc.; styrene and styrene derivatives such as α-methylstyrene, vinyltoluene, chloromethylstyrene, divinylbenzene; ethylenically unsaturated esters of organic acids, such as vinyl acetate, allyl acetate; esters of ethylenically unsaturated carboxylic acids such as methyl acrylate, methyl methacrylate, n-butyl acrylate, n-butyl methacrylate, benzyl acrylate, benzyl methacrylate, cyclohexyl acrylate, cyclohexyl methacrylate, 2-ethylhexyl acrylate, hydroxyethyl methacrylate, ethylene glycol methacrylate, poly(ethyloxy)methacrylate; amides of ethylenically unsaturated carboxylic acids such as acrylamide, N-methylol acrylamide; dienes such as butadiene, isoprene; nonionic monomers such as acrylonitrile, vinyl chloride, trivinylcyclohexane, maleic anhydride; cationic monomers such as vinylbenzyl trimethylammonium salt, methacryloxyethyl trimethylammonium salt, 2-hydroxy-3-methacryloxypropyl triethylammonium salt, N,N-dimethylaminoethyl methacrylate hydrochloride; and anionic monomers such as acrylic acid, methacrylic acid, maleic acid, styrenesulfonic acid, and the salts thereof. Among these monomers, styrene or the styrene derivatives, the esters of ethylenically unsaturated carboxylic acids, the nonionic monomers, the cationic monomers and the anionic monomers are more preferred, and styrene or the styrene derivatives are particularly preferred.

$R^1$ in the general formula represents hydrogen, a halogen atom or an alkyl group having 1 to 3 carbon atoms, and hydrogen is particularly preferred. $R^2$ represents a monovalent substituent and examples of such a substituent are a halogen atom, a nitro group, an amino group, an alkylamino group, a carboxy group, a sulfonic acid group, a carboxylic acid ester group, a sulfonic acid ester group, a carbamoyl group, a sulfamoyl group, an alkylsulfonyl group, an alkoxy group, a thioalkoxy group, an alkyl group and an aryl group. Examples of these substituents are further described in *Kagaku Binran, Kisohen II* (Chemical Handbook, Chapter II), 2nd Edition, pages 1012–1013, edited by Chemical Society of Japan (published by Maruzen K.K.) and *Acta Chim. Sinica,* 32, 107 (1966).

$R^2$ preferably represents a halogen atom, a nitro group, an alkyl group such as a methyl group or an ethyl group, etc.; and two $R^2$ groups may combine with each other to form a ring such as, for example, a benzene ring, fused with the benzene ring shown in formula (I).

$R_f$ represents an alkyl group having 1 to 30 carbon atoms, preferably 1 to 20 carbon atoms, particularly preferably 2 to 12 carbon atoms, an aralkyl group, an aryl group or an alkylaryl group at least one hydrogen of each of which has been substituted by a fluorine atom and preferred examples are a perfluoromethyl group, perfluoroethyl group, perfluoropropyl group, perfluorohexyl group, perfluorooctyl group, 2,2,3,3-tetrafluoropropyl group, 2,2,3,3,4,4,5,5-octafluoroamyl group, 2,2,3,3,4,4,5,5,6,6,7,7-dodecafluorobutyl group, 2,2,2-trifluoroethyl group, 2,2,3,3,4,4,4-heptafluorobutyl group, 1,1,1,3,3,3-hexafluoro-2-propyl group, 1,1,1,3,3,3-hexafluoro-2-hydroxy-2-propyl group, 1,1,2,2-tetrafluoro-2-hydroxyethyl group, p-fluorophenyl group, p-trifluoromethylphenyl group, 2,3,4,5,6-pentatrifluoromethylphenyl group.

X represents a divalent coupling group shown by general formula $-(R)_p-L-$ (wherein R is an alkylene group, an arylene group or an aralkylene group, preferably an alkylene group having 1 to 3 carbon atoms; L represents an oxy group, a thioxy group, an imino group, a carbonyl group, a carboxy group, a carbothioxy group, a carboxyamido group, an oxycarbonyl group, a carbamoyl group, a sulfone group, a sulfonamido group, an N-alkylsulfonamido group, a sulfamoyl group, a sulfoxy group or a phosphate group, preferably a carboxyamido group, an oxycarbonyl group or a carbamoyl group; and p is 0 or 1).

In general formula (I), l is an integer of 0 to 4, preferably 0 to 2, more preferably 0; m is an integer of 0 to 3, preferably 0 or 1; n is an integer of 1 to 5, preferably 1 or 2; x is 1 to 100 mol%, preferably 10 to 100 mol%, and y is 0 to 99 mol%, preferably 0 to 90 mol%.

The water-insoluble polymer of the present invention has a solubility of less than 0.1 g per 100 g of water at 20° C.

The polymer of this invention can be obtained by polymerizing the fluorine-containing monomer shown by following general formula (II) or by copolymerizing the monomer of formula (II) with the monomer shown by A in above-described general formula (I). In this case, two or more fluorine-containing monomers shown by formula (II) may be employed and further two or more monomers of A may be also employed:

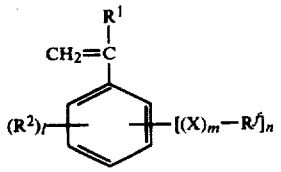

(II)

wherein $R^1$, $R^2$, $R_f$, X, l, m, and n are defined in the same manner as in general formula (I).

The polymer of this invention is produced by various polymerization methods. Examples of these methods include: solution polymerization, emulsion polymerization, reversed phase emulsion polymerization, precipitation polymerization, suspension polymerization and bulk polymerization. Polymerization may also be initiated by using a radical initiator, a thermal polymerization method, a method of irradiating photo or electromagnetic radiation, a cation polymerization method and an anion polymerization method. These polymerization methods and polymerization initiation methods are described in Teiji Tsuruta, *Kobunshi Gosei Hanno* (Polymer Synthesis Reaction), revised edition (published by Nikkan Kogyo Shinbun Sha, 1971) and Fred W. Billmeyer Jr., *Textbook of Polymer Science,* Second Ed. (Wiley-Interscience, 1971).

Of the above-described polymerization methods, the preferred polymerization method is selected according to the properties of the polymer of this invention obtained by the polymerization. Since many of the photographic layers of photographic materials are coated in an aqueous system, it is preferred that the polymer of this invention be dispersible in water. However, the fluorine-containing monomers shown by general formula (II) are generally insoluble in water and the fluorine-containing polymers prepared by homopolymerizing the fluorine-containing monomers shown by general formula (II) are also generally insoluble in water. The water-dispersible polymer of this invention (i.e., the water-insoluble polymer) can be obtained by homopolymerizing the fluorine-containing monomer shown by general formula (II) or by copolymerizing the fluorine-containing monomer of general formula (II) and the monomer shown by A in general formula (I), preferably the water-insoluble monomer. Examples of the water-insoluble monomer include: an olefin such as ethylene, propylene and 1-butene; styrene or a styrene derivative such as α-methylstyrene, vinyltoluene, chloromethylstyrene and divinylbenzene; an ethylenically unsaturated ester of an organic acid, such as vinyl acetate and allyl acetate; an ester of an ethylenically unsaturated carboxylic acid, such as methyl acrylate, methyl methacrylate, n-butyl acrylate, n-butyl methacrylate, benzyl acrylate, benzyl methacrylate, cyclohexyl acrylate, cyclohexyl methacrylate, 2-ethylhexyl acrylate and ethylene glycol dimethacrylate; an amide of an ethylenically unsaturated carboxylic acid, such as N-ethylacrylamide, N-ethylmethacrylamide, N-butylacrylamide and N-butylmethacrylamide; a diene such as butadiene and isoprene; acrylonitrile; vinyl chloride; trivinylcyclohexane; and maleic anhydride. Preferred examples include styrene, a styrene derivative, or an ester of an ethylenically unsaturated carboxylic acid.

The homopolymerization or copolymerization may be performed by the aforesaid various polymerization methods. However, emulsion polymerization is particularly preferred and the water-dispersible polymer thus obtained is generally called "latex". The emulsion polymerization can be performed at temperatures of about 40° to about 100° C., preferably about 50° to 90° C. in the presence of a surface active agent (e.g., sodium lauryl-sulfate) and a radical initiator (e.g., potassium persulfate, ammonium persulfate, and a product commercially available as a trade name V-50, made by Wako Junyaku Kogyo K.K.).

The polymer of this invention is preferably dispersible in water as explained above. However, some of the photographic layers of a photographic material are preferably coated with an organic solvent system, such as a back layer and a subbing layer. When the polymer of this invention is incorporated in such a layer, the polymer of this invention is preferably soluble in an organic solvent or dispersible in an organic solvent and in such a case it will be understood that a polymerization method suitable for obtaining such a polymer be selectively employed.

The polymer of this invention can also be obtained by reacting a fluorine compound having a functional group and the homopolymer of a non-fluorine-containing styrene monomer having a functional group or the copolymer of the styrene monomer and the monomer shown by A in general formula (I). In this case examples of the non-fluorine styrene monomer having a functional group are hydroxymethylstyrene, aminomethylstyrene, aminostyrene, hydroxystyrene, carboxystyrene, mercaptostyrene, mercaptomethylstyrene, chloromethylstyrene and vinylbenzoic acid chloride. Examples of the fluorine compound having a functional group are $R_f$—COCl, $R_f$—OH, $R_f$—$NH_2$ and $R_f$—$SO_2Cl$, wherein $R_f$ has the same meaning as in general formula (I).

Examples of the fluorine-containing monomer shown by general formula (II) used in this invention are shown below:

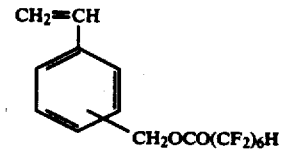

M-1

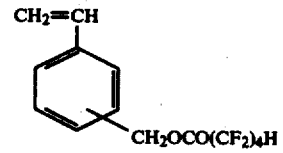

M-2

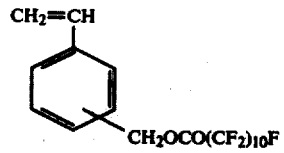

M-3

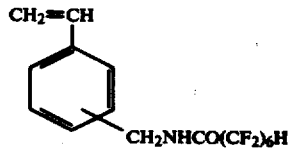

M-4

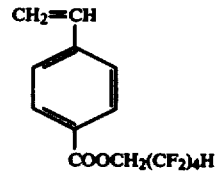

M-5

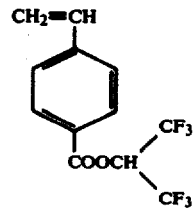

M-6

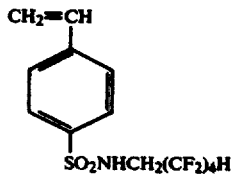

M-7

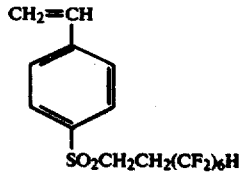

M-8

-continued
M-9
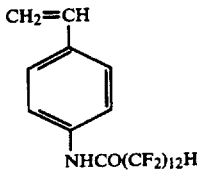
M-10
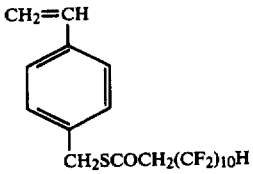
M-11
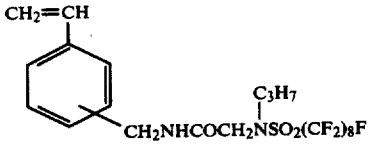
M-12
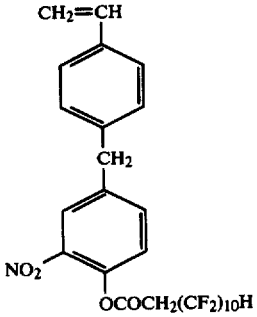
M-13
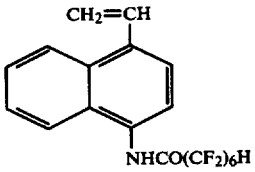
M-14
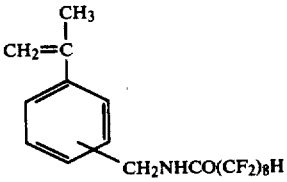
M-15
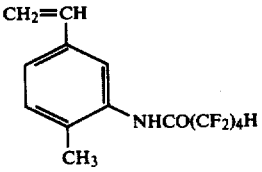
M-16
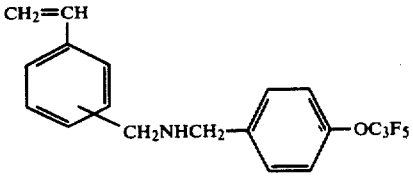
-continued
M-17
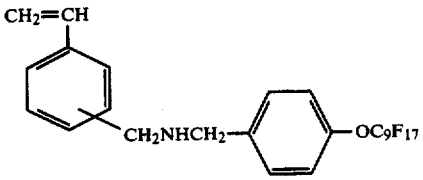
M-18
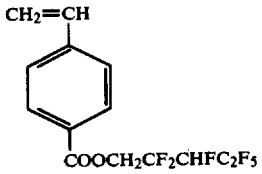
M-19
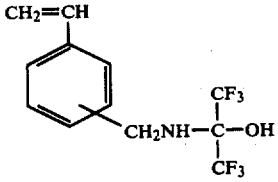
M-20
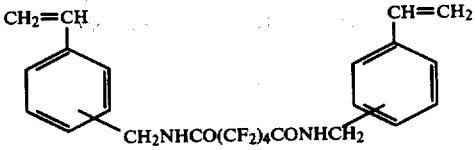
M-21
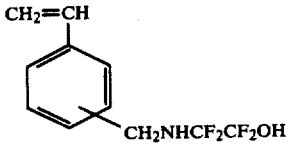
M-22
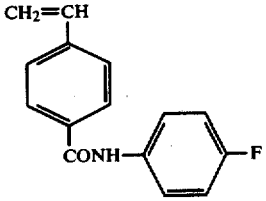
M-23
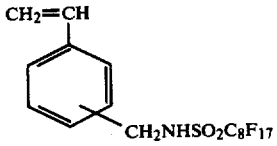
M-24
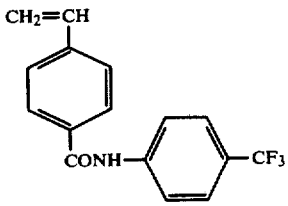

-continued

M-25

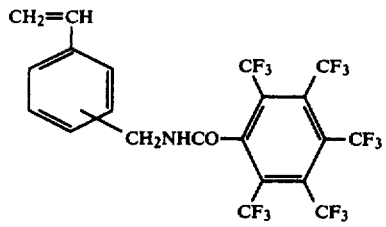

M-26

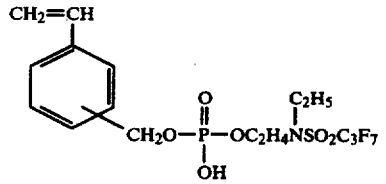

M-27

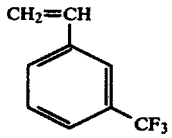

Among the fluorine-containing monomers shown above, M-1, M-2, M-3, M-4 and M-11 are particularly preferred.

Examples of the fluorine-containing polymers of this invention are illustrated below.

Examples of polymers:

P-1 to P-27: The homopolymers of monomers M-1 to M-27 shown above (water-dispersible latices).

P-28

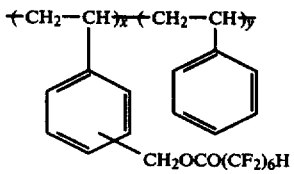

x:y = 50:50 (water-dispersible latex)

P-29

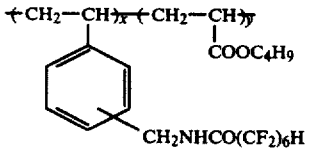

x:y = 40:60 (water dispersible latex)

P-30

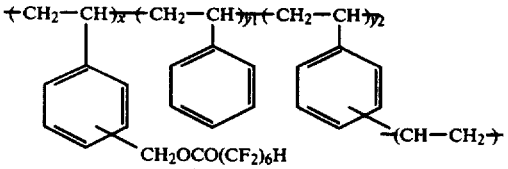

$x:y_1:y_2$ = 50:45:5 (water-dispersible latex)

-continued

P-31

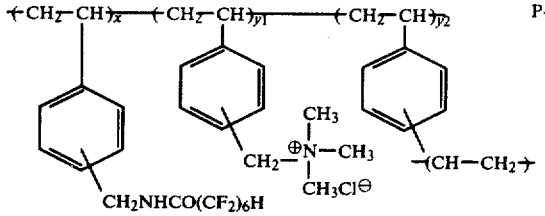

$x:y_1:y_2$ = 35:60:5 (water-dispersible latex)

P-32

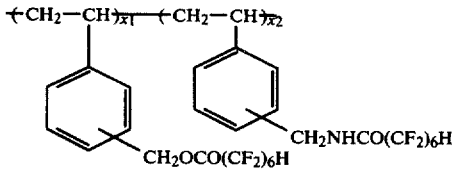

$x_1:x_2$ = 50:50 (water-dispersible latex)

The molecular weight of the fluorine-containing polymers of this invention is preferably within the range from 10,000 to 100,000,000, and more preferably within the range from 1,000,000 to 100,000,000.

Among the fluorine-containing polymers shown above, P-1, P-2, P-3, P-4, P-11, P-28, P-30, P-31 and P-34 are particularly preferred.

Synthesis examples for the polymers and the raw materials therefor are described below:

SYNTHESIS EXAMPLE 1

Synthesis of Monomer (M-1), 2,2,3,3,4,4,5,5,6,6,7,7-dodecafluoro-n-heptanoic acid vinylbenzyl ester In a 500 milliliter three neck flask equipped with a stirrer, a reflux condenser, and a calcium chloride drying tube was placed 289.3 g (0.836 mol) of 2,2,3,3,4,4,5,5,6,6,7,7-dodecafluoro-n-heptanoic acid and then the acid was cooled with ice water. Then, 149.2 g (0.836×1.5 mol) of thionyl chloride was poured slowly into the acid with stirring and 3.3 g (0.836×0.05 mol) of pyridine was further added dropwise to the mixture. Thereafter, the flask was heated to 100° C. and the mixture was stirred for 4 hours. After cooling the reaction mixture, the acicular crystals and light yellow solid materials precipitated were filtered away, remaining thionyl chloride was distilled off, and the chloride of fluorocarboxylic acid thus formed was purified by a normal pressure distillation. Thus, 280.3 g (yield of 92.0%) of 2,2,3,3,4,4,5,5,6,6,7,7-dodecafluoro-n-heptanoic acid chloride (colorless liquid, boiling point of 131°-133° C.) was obtained.

In a 300 milliliter three neck flask equipped with a stirrer, a reflux condenser, and a calcium chloride drying tube were placed 100 ml of diethyl ether, 40.2 g (0.3 mol) of vinylbenzyl alcohol (synthesized from chloromethylstyrene (meta/para ratio of about 6/4) by the method described in *Polymer*, 14, 330 (1973), boiling point of 69°-73° C./0.4 mm Hg), 30.3 g (0.3 mol) of triethylamine, and 0.5 g of 2,6-di-t-butylphenol followed by ice-cooling. Then, 109.4 g (0.3 mol) of 2,2,3,3,4,4,5,5,6,6,7,7-dodecafluoro-n-heptanoic chloride prepared in the aforesaid step was added dropwise to the product under ice-cooling and stirring. Thereafter, the mixture was further stirred for 2 hours at room temperature and further refluxed for 1 hour with stirring. After cooling the reaction mixture, the triethylamine chloride formed was filtered away and the residue was washed twice with water and then further with an aqueous solution of sodium carbonate, and dried by anhydrous sodium carbonate. Then, when the product was purified twice by distillation, 61.0 g (yield of 44.0%) of 2,2,3,3,4,4,5,5,6,6,7,7-dodecafluoro-n-heptanoic acid vinylbenzyl ester (colorless liquid, boiling point of 106°-116° C./0.9 mm Hg, specific gravity of 1.47) was obtained.

SYNTHESIS EXAMPLE 2

Synthesis of Monomer (M-4), 2,2,3,3,4,4,5,5,6,6,7,7-dodecafluoro-n-heptanoic vinylbenzylamide In a 500 milliliter three neck flask equipped with a stirrer and a calcium chloride drying tube were placed 300 ml of acetonitrile, 33.9 g (0.3 mol) of vinylbenzylamine (synthesized from chloromethylstyrene (meta/-para ratio of about 6/4) by the method described in *Kobunshi Gakkai, Yoko Shu* (Polymer Society of Japan), Vol. 26, page 834 (G3, C-07), (1977), boiling point of 82° C./1.5 mm Hg), 30.3 g (0.3 mol) of triethylamine, and 0.5 g of 2,6-di-t-butylphenol followed by ice-cooling. Then, 109.5 g (0.3 mol) of 2,2,3,3,4,4,5,5,6,6,7,7-dodecafluoro-n-heptanoic acid chloride prepared in Synthesis Example 1 was added dropwise to the mixture under ice-cooling and stirring. Thereafter, the mixture was stirred for 1 hour at room temperature and then triethylamine hydrochloride formed was filtered away. After distilling off the solvent, acetonitrile under reduced pressure, the residue was dissolved in 200 ml of ethyl acetate and in this case some white insoluble matters were filtered away. The residue formed was concentrated by vacuum distillation and then 300 ml of n-heptane was added to the concentrate and the mixture was cooled. The white crystals thus formed were recovered by filtration and dried in vacuum at room temperature, thereby 1 g (yield of 65.2%) of 2,2,3,3,4,4,5,5,6,6,7,7-dodecafluoro-n-heptanoic acid vinylbenzylamide (white or light yellow powder, melting point of 53°-57° C.) was obtained.

SYNTHESIS EXAMPLE 3

Synthesis of Polymer (P-1), poly(2,2,3,3,4,4,5,5,6,6,7,7-dodecafluoro-n-heptanoic vinylbenzyl ester) water-dispersible latex In a 300 milliliter of three neck flask equipped with a stirrer and a reflux condenser were placed 30 g (0.066 mol) of a fluorine monomer, monomer (M-1), 15 g of sodium laurylsulfate, and 150 ml of distilled water followed by stirring vigorously. After replacing the inside atmosphere in the reaction vessel with nitrogen and heating the mixture to 80° C., 0.03 g (0.132 millimol) of ammonium persulfate was added to the mixture, thereby a blue-white latex formed. After 30 minutes since then, 0.03 g of ammonium persulfate was added to the latex and after 30 minutes, 0.03 g of ammonium persulfate was further added thereto. Then, after stirring the mixture for 1 hour at 80° C., the reaction mixture was cooled to room temperature and the aggregates slightly observed were filtered away, thereby 176.5 g (solid content of 22.1% by weight, yield for solid content of 86.5% by weight) of the latex of poly(2,2,3,3,4,4,5,5,6,6,7,7-dodecafluoro-n-heptanoic acid vinylbenzyl ester) (average particle size of 0.05 μm) was obtained.

SYNTHESIS EXAMPLE 4

Synthesis of Polymer (P-4), poly(2,2,3,3,4,4,5,5,6,6,7,7-dodecafluoro-n-heptanoic acid vinylbenzylamide) water-dispersible latex In a 500 milliliter three neck flask equipped with a stirrer and a reflux condenser were placed 50 g (0.109 mol) of a fluorine monomer, Monomer (M-4), 25 g of sodium laurylsulfate, and 250 ml of distilled water and the mixture was heated to 80° C. and stirred vigorously. After replacing the atmosphere in the reaction vessel with nitrogen, 0.05 g (0.185 millimol) of potassium persulfate was added to the mixture. After 30 minutes since then, 0.5 g of potassium persulfate was further added, after stirring for 1 hour at 80° C., the mixture was cooled to room temperature, and the aggregates slightly observed were filtered away, thereby 299.3 g (solid content of 22.8% by weight, yield for the solid content of 90.9% by weight) of the latex of poly(2,2,3,3,4,4,5,5,6,6,7,7-dodecafluoro-n-heptanoic acid vinylbenzylamide) (average particle size of 0.04 μm) was obtained.

The amount of the polymer of this invention having the recurring unit shown by general formula (I) depends upon the kind, state and coating system of photographic materials but is generally 0.01 to 5.0 g, preferably 0.01 to 1.0 g per square meter of the photographic material.

The polymer of this invention shown by general formula (I) is applied to the photographic layers of photographic materials by incorporating it in the coating compositions for photosensitive silver halide emulsion layers or photoinsensitive auxiliary layers (e.g., backing layer, antihalation layer, interlayer, protective layer, etc.). The polymer may be applied by itself or in a solution or dispersion of water or organic solvent (e.g., methanol, ethanol, acetone, methyl ethyl ketone, ethyl acetate, acetonitrile, dioxane, dimethylformamide, formamide, dimethyl sulfoxide, methyl cellosolve, ethyl cellosolve, etc.). The solution or dispersion of the polymer may be applied on the surface of a support for photographic material by spraying or coating or the support may be immersed in the solution or dispersion of the polymer followed by drying.

The polymer may be applied as an antistatic layer on a support together with a binder such as gelatin, polyvinyl alcohol, cellulose acetate, cellulose acetate phthalate, polyvinyl formal, polyvinyl butyral.

The layer containing the polymer of this invention shown by general formula (I) or other layer or layers may further contain other antistatic agents, thereby obtaining a more preferable antistatic effect. Examples of such antistatic agents include polymers described in U.S. Pat. Nos. 2,882,157, 2,972,535, 3,062,785, 3,262,807, 3,514,291, 3,615,531, 3,753,716, 3,938,999, 4,070,189, 4,118,231 and 4,147,550, German Patent 2,800,466, Japanese Patent Application (OPI) Nos. 46733/74, 54672/75, 94053/75 and 129520/77; the surface active agents described in U.S. Pat. Nos. 2,982,651, 3,428,456, 3,457,076, 3,454,625, 3,552,872 and 3,655,387; the metal oxides and colloidal silica described in U.S. Pat. Nos. 3,062,700, 3,245,833 and 3,525,621 as well as so-called matting agents such as barium strontium sulfate, polymethyl methacrylate, methyl methacrylate/-methacrylic acid copolymer, colloidal silica, and powder silica. Among the antistatic agents described above, it is preferred that each antistatic agent described in U.S. Pat. Nos. 4,070,189 and 4,118,231 respectively is used together with each other.

The layer which contains the polymer of this invention includes silver halide emulsion layers, a subbing layer disposed at the silver halide emulsion layer side, interlayers, a surface protective layer, an overcoat layer, a back layer disposed at the opposite side to the silver halide emulsion layer. Of these layers, it is preferable to include the polymer in the uppermost surface layer such as a surface protective layer, overcoat layer, or back layer.

The supports for photographic materials to which the polymer of this invention is applied include films of polyolefin such as polyethylene; polystyrene; a cellulose derivative such as cellulose triacetate; and a polyester such as polyethylene terephthalate; as well as baryta-coated papers, synthetic papers, and polymer-coated papers.

The support used in this invention may include an antihalation layer. An antihalation layer may include carbon black or various dyes such as oxonol dyes, azo dyes, allylidene dyes, styryl dyes, anthraquinone dyes, merocyanine dyes, and di- or triallylmethane dyes. Binders for the carbon black or dye include cellulose di- or monoacetate, polyvinyl alcohol, polyvinyl butyral, polyvinyl acetal, polyvinyl formal, polymethacrylic acid ester, polyacrylic acid ester, polystyrene, styrene/maleic anhydride copolymer, polyvinyl acetate, vinyl acetate/maleic anhydride copolymer, methyl vinyl ether/maleic anhydride copolymer, polyvinylidene chloride, and the derivatives of them.

Photograpic materials which can make use of this invention include ordinary black-and-white silver halide photographic materials (e.g., photographing black-and-white photographic materials, X-ray black-and-white photographic materials, printing black-and-white photographic materials), ordinary multilayer color photographic materials (e.g., color reversal films, color negative films and color positive films). The effect of this invention is particularly high when using silver halide photographic materials for high temperature quick processing and high speed silver halide photographic materials.

Photographic layers of the silver halide photographic materials of this invention are described below.

Useful binders for the photographic layers include protein such as gelatin and casein; cellulose compounds such as carboxymethyl cellulose, hydroxyethyl cellulose; sugar derivatives such as agar, sodium alginate and starch derivatives; synthetic hydrophilic colloids such as polyvinyl alcohol, poly-N-vinylpyrrolidone, polyacrylic acid copolymer, polyacrylamide, and the derivatives or partially hydrolyzed products thereof.

The term "gelatin" in this specification means so-called lime-processed gelatin, acid-processed gelatin, and enzyme-processed gelatin.

Gelatin may be partially or wholly replaced with a synthetic polymer as well as a so-called gelatin derivative. The term "gelatin" also includes gelatin denatured by treating the amino group, imino group, hydroxy group or carboxy group contained in the molecule of gelatin as a functional group with a reagent having one group capable of reacting with the group or a graft polymer prepared by grafting the molecular chain of a polymer to gelatin.

There are no particular restrictions on the method of preparation, and chemical sensitization method of the silver halide emulsion layers of the photographic materials, anti-fogging agents, stabilizers, hardening agents, antistatic agents, plasticizers, lubricants, coating aids, matting agents, whitening agents, spectral sensitizing dyes, dyes or color couplers used in this invention. Useful examples are described in *Product Licensing*, Vol. 92, 107–110 (December, 1971) and Research Disclosure, Vol. 176, 22–31 (December, 1978).

Particularly useful anti-fogging agents and stabilizers include 4-hydroxy-6-methyl-1,3,3a,7-tetraazaindene-3-methylbenzothiazole, 1-phenyl-5-mercaptotetrazole, as well as other various heterocyclic compounds, mercury-containing compounds, mercapto compounds and metal salts. Useful hardening agents include aldehyde compounds such as mucochloric acid, mucobromic acid, mucophenoxychloric acid, mucophenoxybromic acid, formaldehyde, dimethylolurea, trimethylolmelamine, glyoxal, monomethylglyoxal, 2,3-dihydroxy-1,4-dioxane, 2,3-dihydroxy-5-methyl-1,4-dioxane, succinaldehyde, 2,5-dimethoxytetrahydrofuran and glutaraldehyde; active vinylic compounds such as divinylsulfone, methylenebismaleimide, 5-acetyl-1,3-diacryloyl-hexahydro-s-triazine, 1,3,5-triacryloyl-hexahydro-s-triazine, 1,3,5-trivinylsulfonyl-hexahydro-s-triazinebis(-vinylsulfonylmethyl) ether and 1,3-bis(vinylsulfonylmethyl)propanol-2, bis(αvinylsulfonylacetamido)ethane; active halogen compounds such as 2,4-dichloro-6-hydroxy-s-triazine.sodium salt, 2,4-dichloro-6-methoxy-s-triazine, 2,4-dichloro-6-(4-sulfoanilino)s-triazine.-sodium salt, 2,4-dichloro-6-(2-sulfoethylamino)-s-triazine and N,N'-bis(2-chloroethylcarbamyl)piperazine; epoxy compounds such as bis(2,3-epoxypropyl)methylpropylammonium.p-toluenesulfonate, 1,4-bis(2',3'-epoxypropyloxy)butane, 1,3,5-triglycidyl isocyanurate and 1,3-diglycidyl-5-(γ-acetoxy-β-oxypropyl)isocyanurate; ethyleneimine compounds such as 2,4,6-triethyleneimino-s-triazine, 1,6-hexamethylene-N,N'-bisethyleneurea and bis-β-ethyleneiminoethyl thioether; methanesulfonic acid ester compounds such as 1,2-di(-methanesulfonoxy)ethane, 1,4-di(methanesulfonoxy)butane and 1,5-di(methanesulfonoxy)pentane; carbodiimide compounds; isooxazole compounds, and inorganic compounds such as chrome alum.

The photographic layers containing the polymer of this invention may further contain known surface active agents solely or as a mixture of them. Useful surface active agents include natural surface active agents such as saponin, etc.; nonionic surface active agents such as alkylene oxide series, glycerol series, and glycidol series surface active agents; cationic surface active agents such as higher alkylamines, quaternary ammonium salts, pyridine and other heterocyclic compounds, phosphoniums and sulfoniums; anionic surface active agents containing an acid group such as carboxylic acid, sulfonic acid, phosphoric acid, sulfuric acid ester and phosphoric acid ester; and amphoteric surface active agents such as aminoacids, aminosulfonic acids, aminoalcohol sulfuric acid or phosphoric acid ester.

The photographic materials of this invention may also contain in the photographic layers the alkyl acrylate series latices described in U.S. Pat. Nos. 3,411,911, 3,411,912 and 3,525,620.

The invention will be explained further by the following examples but the invention shall not be limited by these examples.

EXAMPLE 1

Antistatic Property Test and Deterioration Test Thereof with Time (1) Preparation of Sample:

A black-and-white silver halide photographic material was prepared by coating a silver halide emulsion having the following composition on a polyethylene terephthalate film 180μ thick. The film had a subbing layer. After coating the silver halide emulsion thereon a protective layer having the following composition was coated thereon followed by drying. To the coating composition for the protective layer was added the polymer of this invention.

| Silver Halide Emulsion Layer | |
|---|---|
| Thickness: about 5 microns | |
| Composition and coverage: | |
| Gelatin | 2.5 g/m$^2$ |
| Silver iodobromide (1.5 mol % silver iodide) | 5 g/m$^2$ |
| 1-Phenyl-5-mercaptotetrazole | 25 mg/m$^2$ |

| Protective Layer | |
|---|---|
| Thickness: about 1 micron | |
| Composition and coverage: | |
| Gelatin | 1.7 g/m$^2$ |
| 2,6-Dichloro-6-hydroxy-1,3,5-triazine sodium salt | 10 mg/m$^2$ |
| Sodium N—oleyl-N—methyltaurinate | 7 mg/m$^2$ |
| The polymer of this invention or comparison fluorine-containing surface active agent | See Table 1 |

(2) Test Method:

Charged voltage measurement method:

The sample described above was cut into a rectangle of 30 cm×4 cm. Two sheets of the sample were put together at the support surfaces using a duplicated adhesive tape so that the protective layers of both sheets were in the opposite sides. After humidifying each of the samples for 5 hours under the conditions of 25° C. and 25% RH, the sample was passed through two rotary white Neoprene rollers (roller diameter of 12 cm, width 1 cm, pressure between rollers of 6 kg/cm$^2$, and rotation line speed of 320 m/min), and then the charged voltage was measured by means of an electrometer in a Faraday cage.

Deterioration test method:

After humidifying the above-described samples and white wood-free papers for one hour at 25° C. and 70% RH, the wood-free paper was sandwiched by two sheets of the sample so that the surfaces of the emulsion layers were brought into contact with both surfaces of the paper and they were placed in a polyethylene-laminated bag followed by sealing up. A load of 4 g/cm$^2$ was applied onto each sample assembly and they were allowed to stand in that state for 1 week at room temperature. Thereafter, the charged voltage was measured by the above-mentioned charged voltage measuring method and the results were compared with the results obtained by measuring before allowing the samples to stand for the definite period of time.

(3) Test Results:

The charged voltage measured results are shown in Table 1.

TABLE 1

| Sample No. | Antistatic Agent | Coverage (mg/m$^2$) | Charged Voltage (volt) Before* | After* | Remarks |
|---|---|---|---|---|---|
| 1 | None | — | +440 | +450 | Control |
| 2 | Polymer (P-1) | 55 | +60 | +70 | Present Invention |
| 3 | Polymer (P-1) | 65 | +20 | +20 | Present Invention |
| 4 | Polymer (P-1) | 75 | 0 | 0 | Present Invention |
| 5 | Polymer (P-1) | 85 | −20 | −10 | Present Invention |
| 6 | Polymer (P-2) | 90 | −10 | 0 | Present Invention |
| 7 | Polymer (P-3) | 65 | 0 | 0 | Present Invention |
| 8 | Polymer (P-4) | 90 | +10 | +10 | Present Invention |
| 9 | Polymer (P-5) | 80 | 0 | +10 | Present Invention |
| 10 | Polymer (P-6) | 120 | +10 | −10 | Present Invention |
| 11 | Polymer (P-7) | 80 | −10 | 0 | Present Invention |
| 12 | Polymer (P-11) | 65 | 0 | +10 | Present Invention |
| 13 | Polymer (P-28) | 100 | +10 | +10 | Present Invention |
| 14 | Polymer (P-29) | 110 | 0 | −10 | Present Invention |
| 15 | Polymer (P-30) | 100 | 0 | 0 | Present Invention |
| 16 | Polymer (P-31) | 200 | +10 | −10 | Present Invention |
| 17 | F-containing** surface active agent | 3.5 | +320 | +400 | Comparison |
| 18 | F-containing** surface active agent | 8.5 | +190 | +320 | Comparison |
| 19 | F-containing** surface active agent | 12 | 0 | +160 | Comparison |

*Before or after allowing the sample to stand for a definite period of time.
**Fluorine-containing surface active agent; $H(CF_2)_6COONa$ From the results shown in the above table, it can be seen that a great deal of electrostatic charge was generated in the sample containing no antistatic agent (Sample No. 1). However, of samples containing proper amounts of polymers of this invention, Sample Nos. 4 and 6 to 16 did not generate any substantial electrostatic charge, and this property did not change substantially with the passage of time. The sample containing a proper amount of the fluorine-containing surface active agent (Sample No. 19) did not generate electrostatic charge until the sample was allowed to stand for a period of time but the generation of electrostatic charge became larger with the passage of time. Thus, it was confirmed that the antistatic faculty of the polymers of this invention was very good and the polymers of this invention did not show deterioration in antistatic property with the passage of time as distinct from a conventional fluorine-containing surface active agent.

EXAMPLE 2

Photographic Property Test (1) Test Method:

Black-and-white silver halide photographic material samples (1) to (16) containing the polymers of this invention as shown in Example 1 were exposed to a tungsten lamp through Filter SP-14, made by Fuji Photo Film Co., Ltd., developed (for 30 sec at 35° C.) by the developer having the following composition, fixed, washed with water, and then the photographic properties were determined.

| Developer Composition: | |
|---|---|
| Warm water | 800 ml |
| Sodium tetrapolyphosphate | 2.0 g |
| Anhydrous sodium sulfite | 50 g |
| Hydroquinone | 10 g |
| Sodium carbonate (monohydrate) | 40 g |
| 1-Phenyl-3-pyrazolidone | 0.3 g |
| Potassium bromide | 2.0 g |
| Water to make | 1,000 ml |

(2) Test Results:

The results of the photographic property test are shown in Table 2.

TABLE 2

| Sample No. | Antistatic Agent | Fog | Sensitivity | Maximum Density | Remarks |
|---|---|---|---|---|---|
| 1 | None | 0.16 | 100 | 2.5 | Control |
| 2 | Polymer (P-1) | 0.16 | 100 | 2.5 | Present Invention |
| 3 | Polymer (P-1) | " | " | " | Present Invention |
| 4 | Polymer (P-1) | " | " | " | Present Invention |
| 5 | Polymer (P-1) | " | " | " | Present Invention |
| 6 | Polymer (P-2) | " | " | " | Present Invention |
| 7 | Polymer (P-3) | " | " | " | Present Invention |
| 8 | Polymer (P-4) | " | " | " | Present Invention |
| 9 | Polymer (P-5) | " | " | " | Present Invention |
| 10 | Polymer (P-6) | " | " | " | Present Invention |
| 11 | Polymer (P-7) | " | " | " | Present Invention |
| 12 | Polymer (P-11) | " | " | " | Present Invention |
| 13 | Polymer (P-28) | " | " | " | Present Invention |
| 14 | Polymer (P-29) | " | " | " | Present Invention |
| 15 | Polymer (P-30) | " | " | " | Present Invention |
| 16 | Polymer (P-31) | " | " | " | Present Invention |

From the above results, it is understood that the polymers of this invention did not have bad influences on the photographic properties of the photographic materials.

EXAMPLE 3

Film Strength Test (1) Preparation of Sample:

Samples (1) to (16) described in Example 1 were used as samples (1) to (16) respectively in this example. Furthermore, black-and-white silver halide photographic materials containing the fluorine-containing polymer* described in Example 1 of British Pat. No. 1,497,256 incorporated herein by reference were prepared as comparison sample as samples (20) to (23).

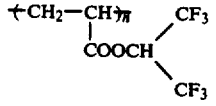

(*)

(2) Test Method:

Each of samples (1) to (16) and (20) to (23) described above was immersed in water at 25° C. for 5 minutes. A needle having a steel ball of 0.4 mm radius was brought into contact with the emulsion layer surface of each sample under pressure and while moving the needle over the surface at a speed of 5 mm/sec, the load applied onto the needle was continuously changed in the range of 0 to 200 g weight, and then the load which began to form scratches on the surface of the sample was measured.

(3) Test Results:

The results are shown in Table 3.

TABLE 3

| Sample No. | Antistatic Agent | Coverage (mg/m$^2$) | Film Strength | Remarks |
|---|---|---|---|---|
| 1 | None | — | 53 | Control |
| 2 | Polymer (P-1) | 55 | 54 | Invention |
| 3 | Polymer (P-1) | 65 | 52 | " |
| 4 | Polymer (P-1) | 75 | 53 | " |
| 5 | Polymer (P-1) | 85 | 52 | " |
| 6 | Polymer (P-2) | 90 | 53 | " |
| 7 | Polymer (P-3) | 65 | 52 | " |
| 8 | Polymer (P-4) | 90 | 53 | " |
| 9 | Polymer (P-5) | 80 | 52 | " |
| 10 | Polymer (P-6) | 120 | 51 | " |
| 11 | Polymer (P-7) | 80 | 53 | " |
| 12 | Polymer (P-11) | 65 | 52 | " |
| 13 | Polymer (P-28) | 100 | 54 | " |
| 14 | Polymer (P-29) | 110 | 51 | " |
| 15 | Polymer (P-30) | 100 | 55 | " |
| 16 | Polymer (P-31) | 200 | 51 | " |
| 20 | Comparison F-containing polymer | 55 | 49 | Comparison |
| 21 | Comparison F-containing polymer | 65 | 45 | " |
| 22 | Comparison F-containing polymer | 75 | 43 | " |
| 23 | Comparison F-containing polymer | 85 | 40 | " |

From the above results, it is understood that the polymers of this invention barely, if any, reduced the film strength, while the fluorine-containing polymer described in British Pat. No. 1,497,256 greatly reduced the film strength.

EXAMPLE 4

Adhesion Resistance Test (1) Test Method:

Each of samples (1) to (16) and (20) to (23) as described in Examples 1 and 3 was cut into a square sheet of 4 cm×4 cm. After humidifying these samples for 2 days at 25° C. and 70% RH, the surfaces of the silver halide emulsion sides of the two sheets were brought into contact with each other and while applying a load of 800 g onto the sheets, they were allowed to stand for 1 day under the conditions of 50° C. and 70% RH. The samples were separated from each other, the adhered area was measured, and the result was evaluated by the following standard:

| | |
|---|---|
| Rank A | 0–40% adhered area |
| Rank B | 41–60% adhered area |
| Rank C | 61–80% adhered area |
| Rank D | 81–100% adhered area |

(2) Test Results:

The results obtained are shown in Table 4.

TABLE 4

| Sample No. | Antistatic Agent | Coverage (mg/m²) | Evaluation of Adhered Area | Remarks |
|---|---|---|---|---|
| 1 | None | — | Rank B | Control |
| 2 | Polymer (P-1) | 55 | Rank B | Present Invention |
| 3 | Polymer (P-1) | 65 | Rank B | Present Invention |
| 4 | Polymer (P-1) | 75 | Rank B | Present Invention |
| 5 | Polymer (P-1) | 85 | Rank A | Present Invention |
| 6 | Polymer (P-2) | 90 | Rank A | Present Invention |
| 7 | Polymer (P-3) | 65 | Rank B | Present Invention |
| 8 | Polymer (P-4) | 90 | Rank B | Present Invention |
| 9 | Polymer (P-5) | 80 | Rank B | Present Invention |
| 10 | Polymer (P-6) | 120 | Rank A | Present Invention |
| 11 | Polymer (P-7) | 80 | Rank B | Present Invention |
| 12 | Polymer (P-11) | 65 | Rank B | Present Invention |
| 13 | Polymer (P-28) | 100 | Rank B | Present Invention |
| 14 | Polymer (P-29) | 110 | Rank A | Present Invention |
| 15 | Polymer (P-30) | 100 | Rank B | Present Invention |
| 16 | Polymer (P-31) | 200 | Rank A | Present Invention |
| 20 | Comparison F-containing polymer | 55 | Rank C | Comparison |
| 21 | Comparison F-containing polymer | 65 | Rank C | Comparison |
| 22 | Comparison F-containing polymer | 75 | Rank C | Comparison |
| 23 | Comparison F-containing polymer | 85 | Rank C | Comparison |

The results of table 4 show that the photographic materials containing the fluorine-containing polymer described in British Pat. No. 1,497,256 were greatly inferior in adhesion resistance. However, the photographic materials containing the polymers of this invention had an adhesion resistance the same as or better than the control.

EXAMPLE 5

Antistatic Property Test and Deterioration with Time Test

In Examples 1 to 4 the polymers of this invention were in the layers containing gelatin as a binder. However, this example shows that a good antistatic effect is obtained by incorporating the polymers of this invention in layers containing no binder.

(1) Preparation of Sample:

A sample having an antistatic subbing layer was prepared by applying a subbing layer containing 4 g/m² of gelatin on a polyethylene terephthalate film 180μ thick followed by drying and then coating thereon an aqueous dispersion of the polymer of this invention or an aqueous solution of a comparison fluorine-containing surface active agent, sodium 1,1,2,2,3,3,4,4,5,5,6,6-dodecafluorohexanesulfonate followed by drying.

(2) Test Method and Results:

The antistatic property and the deterioration thereof with passage of time were tested in the same manner as in Example 1. The results are shown in Table 5. In addition, the silver halide emulsion layer side in Example 1 corresponds to the subbing layer side in this example.

TABLE 5

| Sample No. | Antistatic Agent | Concentration* (wt %) | Charged Voltage (volt) Before** | After** | Remarks |
|---|---|---|---|---|---|
| 24 | None | — | +380 | +400 | Control |
| 25 | Polymer (P-1) | 0.1 | +60 | +50 | Present Invention |
| 26 | Polymer (P-1) | 0.2 | +30 | +30 | Present Invention |
| 27 | Polymer (P-1) | 0.4 | 0 | 0 | Present Invention |
| 28 | Polymer (P-1) | 0.6 | −20 | −10 | Present Invention |
| 29 | Polymer (P-2) | 0.5 | 0 | 0 | Present Invention |
| 30 | Polymer (P-3) | 0.3 | +10 | 0 | Present Invention |
| 31 | Polymer (P-4) | 0.4 | −10 | −10 | Present Invention |
| 32 | Polymer (P-5) | 0.6 | −10 | 0 | Present Invention |
| 33 | Polymer (P-6) | 0.7 | 0 | +10 | Present Invention |
| 34 | Polymer (P-7) | 0.5 | 0 | 0 | Present Invention |
| 35 | Polymer (P-11) | 0.2 | +10 | −10 | Present Invention |
| 36 | Polymer (P-28) | 0.5 | 0 | 0 | Present Invention |
| 37 | Polymer (P-29) | 0.5 | 0 | −10 | Present Invention |
| 38 | Polymer (P-30) | 0.5 | +10 | −10 | Present Invention |
| 39 | Polymer (P-31) | 0.6 | −10 | +10 | Present Invention |
| 40 | Comparison F-containing surface active agent | 0.2 | −10 | +250 | Comparison |
| 41 | Comparison F-containing surface active agent | 0.4 | −100 | +160 | Comparison |
| 42 | Comparison F-containing surface active agent | 0.6 | −240 | +90 | Comparison |

*concentration of the coating solution;
**before or after allowing the sample to stand for a definite period of time The results shown in Table 5 show that samples coated with a solution of the polymer of this invention, said solution containing no binder, have a good antistatic property. This antistatic property did not substantially deteriorate with the passage of time in comparison with samples containing the comparison fluorine-containing surface active agent.

While the invention has been described in detail and with reference to specific embodiments thereof, it will be apparent to one skilled in the art that various changes and modifications can be made therein without departing from the spirit and scope thereof.

What is claimed is:

1. A silver halide photographic material, comprising: a support; a plurality of photographic layers on the support, wherein at least one of said layers comprises a water-insoluble polymer having a recurring unit represented by formula (I)

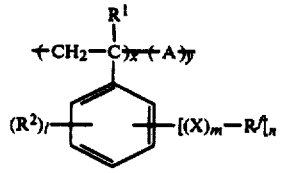

(I)

wherein A represents a monomer unit formed by copolymerizing a copolymerizable monomer having at least one ethylenically unsaturated group; $R^1$ represents hydrogen, a halogen atom, or an alkyl group having 1 to 3 carbon atoms; $R^2$ can represent a monovalent substituent, and, when l is more than one, two $R^2$ groups together can represent an atomic group forming a ring; $R^f$ represents an alkyl group having 1 to 30 carbon atoms, an aralkyl group, an aryl group, or an alkylaryl group, wherein at least four hydrogens have been substituted with a fluorine atom; X represents a divalent coupling group shown by $-(R)_p-L-$, wherein R represents an alkylene group, an arylene group, or an aralkylene group; L represents an oxy group, a thioxy group, an imino group, a carbonyl group, a carboxy group, a carbothioxy group, a carboxyamido group, an oxycarbonyl group, a carbamoyl group, a sulfone group, a sulfonamido group, an N-alkyl-sulfonamido group, a sulfamoyl group, a sulfoxy group, or a phosphate group; and p is 0 or 1; l is an integer of 0 to 4; m is an integer of 0 to 3; n is an integer of 1 to 5; x is 1 to 100 mol%; and y is 0 to 99 mol%.

2. A photographic material as in claim 1, wherein A represents styrene or a styrene derivative; $R^1$ represents hydrogen; $R^2$ represents a halogen atom, a nitro group, or an alkyl group; $R^f$ represents an alkyl group having from 2 to 12 carbon atoms, wherein at least four hydrogens have been substituted with a fluorine atom; X represents a divalent coupling group shown by $-(R)_p-L-$, wherein R represents an alkylene group having from 1 to 3 carbon atoms, L represents a carboxyamido group, an oxycarbonyl group, or a carbamoyl group; and p is 0 or 1; l is an integer of 0 to 2; m is an integer of 0 or 1; n is an integer of 1 or 2; x is 10 to 100 mol% and y is 0 to 90 mol%.

3. A photographic material as in claim 2, wherein the water-insoluble polymer having a recurring unit represented by formula (I) is a homopolymer.

4. A photographic material as in claim 2, wherein the water-insoluble polymer having a recurring unit represented by formula (I) is a copolymer.

5. A photographic material as in claim 1, wherein the solubility of the polymer per 100 g water at 20° C. is less than 0.1 g.

6. A photographic material as in claim 1, wherein the water-insoluble polymer having a recurring unit represented by formula (I) is a water-dispersible latex.

7. A photographic material as in claim 1, wherein the water-insoluble polymer having the recurring unit represented by formula (I) is incorporated in a surface layer.

8. A photographic material as in claim 1, wherein the amount of polymer having the recurring unit represented by formula (I) is from 0.01 to 5.0 g per square meter of the photographic material.

* * * * *